US009636684B2

(12) United States Patent
Takeno et al.

(10) Patent No.: US 9,636,684 B2
(45) Date of Patent: May 2, 2017

(54) VERTICAL PULVERIZING APPARATUS

(71) Applicant: Mitsubishi Hitachi Power Systems, Ltd., Yokohama-shi, Kanagawa (JP)

(72) Inventors: Yutaka Takeno, Kure (JP); Hiroaki Kanemoto, Kure (JP); Teruaki Tatsuma, Kure (JP); Hideo Mitsui, Kure (JP); Takashi Aizawa, Kure (JP)

(73) Assignee: Mitsubushi Hitachi Power Systems, Ltd., Yokohama-shi (JP)

( * ) Notice: Subject to any disclaimer, the term of this patent is extended or adjusted under 35 U.S.C. 154(b) by 286 days.

(21) Appl. No.: 14/388,123

(22) PCT Filed: Mar. 25, 2013

(86) PCT No.: PCT/JP2013/058568
§ 371 (c)(1),
(2) Date: Sep. 25, 2014

(87) PCT Pub. No.: WO2013/146678
PCT Pub. Date: Oct. 3, 2013

(65) Prior Publication Data

US 2015/0321197 A1 Nov. 12, 2015

(30) Foreign Application Priority Data

Mar. 26, 2012 (JP) ..... 2012-069741

(51) Int. Cl.
*B02C 15/00* (2006.01)
*F23K 1/00* (2006.01)
*B02C 23/12* (2006.01)

(52) U.S. Cl.
CPC ..... *B02C 15/007* (2013.01); *B02C 15/001* (2013.01); *B02C 23/12* (2013.01); *F23K 1/00* (2013.01); *F23K 2201/103* (2013.01)

(58) Field of Classification Search
CPC ..... B02C 15/007; B02C 15/001
(Continued)

(56) References Cited

U.S. PATENT DOCUMENTS 4,600,157 A * 7/1986 Willach ..... B02C 15/007 241/119
4,721,258 A * 1/1988 Dougan ..... B02C 15/001 241/103
(Continued)

FOREIGN PATENT DOCUMENTS

JP 2-273555 A 11/1990
JP 3-217249 A 9/1991
(Continued)

OTHER PUBLICATIONS

International Search Report dated Jun. 18, 2013 with English translation (six (6) pages).

*Primary Examiner* — Faye Francis
(74) *Attorney, Agent, or Firm* — Crowell & Moring LLP

(57) ABSTRACT

Provided is a vertical pulverizing apparatus capable of suppressing abrasion of throat vanes (40) and elongating their abrasion resistant lives to thereby increase working efficiency. The vertical pulverizing apparatus is characterized in that: a throat (4) is provided between a housing (32) and a pulverizing table (2) and has an annular flow channel which is surrounded by a throat inner peripheral wall (41) and a throat outer peripheral wall (42) and which is partitioned by a large number of throat vanes (40); and a slope part (43*a*, 43*b*) extending diagonally downward from an inner peripheral wall surface of the housing (32) toward a top end of the throat outer peripheral wall (42) and a horizontal part (44) extending from a bottom end of the slope part (43*b*) continuously to the top end of the throat outer peripheral wall (42) are provided so that top end
(Continued)

surfaces (40*a*) of the throat vanes (40) and a top surface of the horizontal part (44) can be set at the same height.

7 Claims, 5 Drawing Sheets

(58) Field of Classification Search
USPC ..... 241/117, 119
See application file for complete search history.

(56) References Cited

U.S. PATENT DOCUMENTS

| | | | | | |
|---|---|---|---|---|---|
| 5,263,855 | A * | 11/1993 | Watson | B02C 15/001 | 241/119 |
| 5,340,041 | A * | 8/1994 | Henning | B02C 15/001 | 241/119 |
| 5,819,947 | A * | 10/1998 | Nardi | B02C 15/001 | 209/139.2 |
| 6,079,646 | A * | 6/2000 | Keyssner | B02C 15/001 | 241/107 |
| 8,317,119 | B2 * | 11/2012 | Wark | B02C 15/001 | 241/119 |
| 8,336,796 | B2 * | 12/2012 | Wark | B02C 15/001 | 241/119 |

FOREIGN PATENT DOCUMENTS

| | | | |
|---|---|---|---|
| JP | 6-63143 | U | 9/1994 |
| JP | 4759285 | B2 | 8/2011 |
| JP | 2011-240233 | A | 12/2011 |

* cited by examiner

VERTICAL PULVERIZING APPARATUS

TECHNICAL FIELD

The present invention relates to a vertical pulverizing apparatus capable of pulverizing solid matter such as coal or cement by means of a pulverizing table and a pulverizer such as a pulverizing roller rolling on the pulverizing table, and adjusting the pulverized particles to a predetermined particle size distribution by means of a classification portion. Particularly, it relates to the structure of the vicinities of a throat portion.

BACKGROUND ART

Vertical pulverizing apparatuses are used as fuel supply units in coal fired boiler plants for thermal power generation in which pulverized coal is burned as fuel.

FIG. 7 is a schematic configuration view of a background-art vertical pulverizing apparatus. As shown in FIG. 7, the vertical pulverizing apparatus is mainly constituted by a drive portion A, a pulverization portion B, a classification portion C and a distribution portion D, and the portions have a layout as illustrated.

The drive portion A has a mechanism in which torque is transmitted to a pulverizing table reduction gear 50 from a pulverizing table driving motor 51 placed outside the vertical pulverizing apparatus, and torque of the reduction gear 50 is transmitted to a pulverizing table 2 placed in an upper part of the drive portion A.

In the pulverization portion B, a plurality of pulverizing rollers 3 disposed circumferentially at equal intervals on the pulverizing table 2 are supported by a pressure frame 5, roller pivots 7 and roller brackets 6. The pressure frame 5 disposed inside the vertical pulverizing apparatus is pulled downward through a pressure rod 8 by a pressure device 9 such as a hydraulic cylinder placed outside the vertical pulverizing apparatus, so that a pulverization load can be applied to the roller brackets 6 placed under the pressure frame 5.

Due to the rotation of the pulverizing table 2, the pulverizing rollers 3 rotate together with the pulverizing table 2. Coal 60 inputted through a coal feeding pipe 1 is pulverized by a meshing part between the pulverizing table 2 and each pulverizing roller 3.

The classification portion C is placed above the pulverization portion B and provided with a rotary type classification mechanism 20 having a large number of rotary fins 21. The rotary fins 21 are disposed circumferentially at equal intervals around a hollow rotation shaft 22 disposed on the outer side of the coal feeding pipe 1, and supported by the rotation shaft 22, so that the rotary fins 21 can be rotationally driven through the rotary shaft 22 by a rotary fin driving motor 23.

On the radially outer side of the rotary fins 21, a plurality of fixed fins 12 are disposed circumferentially at equal intervals. The fixed fins 12 are hung on a ceiling part 10 of the vertical pulverizing apparatus. A cone-shaped recovery hopper 11 is coupled to the bottoms of the fixed fins 12. A bottom end opening part (not shown) of the recovery hopper 11 is opened toward the top surfaces of the center portions of the pulverizing rollers 3.

The distribution portion D is placed above the rotary type classification mechanism 20 and constituted by a distributor 33 and a plurality of distribution pipes 34 extending toward a boiler apparatus.

Incidentally, the reference numeral 4 in FIG. 7 represents a throat provided in the outer periphery of the pulverizing table 2; 30, a primary air duct; 31, a primary air wind box; and 32, a housing which receives various members.

Next, the operation of the vertical pulverizing apparatus will be described.

The coal 60 fed from the coal feeding pipe 1 falls down to the central part of the pulverizing table 2 as shown by the arrow. The pulverizing table 2 is rotationally driven through the reduction gear 50 by the driving motor 51. The coal 60 falling down onto the pulverizing table 2 is moved on the pulverizing table 2 toward the outer peripheral part thereof while drawing a spiral locus due to centrifugal force caused by the rotation. Then, the coal 60 is bitten and pulverized between the pulverizing table 2 and each pulverizing roller 3.

A group of particles 62 produced by the pulverization are blown upward above the pulverizing table 2 by conveying primary air 61 introduced from the throat 4 provided in the outer periphery of the pulverizing table 2. Of the group of particles 62 blown upward, particles with a large particle size fall down by gravity on the way of being conveyed to the classification portion C, and are returned to the pulverization portion B (primary classification).

The group of particles 62 arriving at the classification portion C are classified into fine particles 63 which are not larger than a predetermined particle size and coarse particles 64 which are larger than the predetermined particle size by the fixed fins 12 and the rotary fins 21 (secondary classification). The coarse particles 64 recovered by the recovery hopper 11 fall down to the pulverization portion B and are pulverized again. On the other hand, the fine particles 63 passing through the fixed fins 12 and the rotary fins 21 are distributed to the plurality of distribution pipes 34 in the distributor 33, and conveyed to a burner of a not-shown boiler apparatus in the form of a vapor phase.

An example of the throat 4 in the background-art vertical pulverizing apparatus is shown in FIG. 8 and FIG. 9. FIG. 8 is a sectional view showing the vicinities of the throat 4, and FIG. 9 is a development view of the throat 4.

As shown in FIG. 8, the throat 4 is an annular flow channel surrounded by a throat inner peripheral wall 41 and a throat outer peripheral wall 42. In order to enhance the primary classification, a large number of throat vanes 40 inclined at a desired angle $\alpha$ with respect to a rotation direction X of the pulverizing table 2 are placed at intervals in the circumferential direction of the throat 4 so as to give a turning force to the primary air 61 jetted from the throat 4.

An annular slope part 43 is placed between the housing 32 and the throat outer peripheral wall 42 so as to be lowered from the housing 32 toward the throat outer peripheral wall 42. Although the throat 4 is a rotary type throat rotating together with the pulverizing table 2 in this example, a fixed type throat attached to the housing 32 may be used as the throat 4.

When a flammable material such as coal which is pulverized by the vertical pulverizing apparatus is deposited locally inside the vertical pulverizing apparatus, there is a danger that the deposited flammable material may be heated by the high-temperature primary air 61 supplied from the throat 4, resulting in ignition.

Therefore, as shown in FIG. 8, the slope part 43 is provided so that particles 68 falling down along the inner peripheral wall surface of the housing 32 can be moved to the top of the throat 4 quickly without being deposited. It is generally thought that the slope angle of the slope part 43 has to be made not smaller than 30 degrees in view of the repose angle of powder.

It is also thought that it is desirable that the throat inner peripheral wall 41 and the throat outer peripheral wall 42 are inclined toward the central axis of the vertical pulverizing apparatus. This is to vertically blow particles supplied from the pulverizing table 2 to the top of the throat 4. That is, inward momentum is given to the primary air 61 jetted from the throat 4 in order to cancel outward momentum of the particles.

Further, when the throat vanes 40 are shaped into rectangles, manufacturing can be made easy. As shown in FIG. 8, therefore, each throat vane 40 has a top end surface 40*a* inclined to be higher on its outer side.

CITATION LIST

Patent Literature

Patent Literature 1: Japanese Patent No. 4759285

SUMMARY OF INVENTION

Technical Problem

The throat 4 is abraded gradually with age due to collision with pulverized solid particles. Particularly the throat vanes 40 are abraded most severely. When the abrasion amount of the throat vanes 40 reaches a predetermined value, the throat 4 must be replaced by a new one.

A work schedule of several weeks is required to replace the throat 4 in a large-sized vertical pulverizing apparatus used in a coal fired boiler plant. The vertical pulverizing apparatus cannot be operated during that time, causing a hindrance to the operation of the boiler plant. For this reason, there is a request to make the abrasion resistant life of the throat 4 as long as possible, to thereby reduce the replacement frequency of the throat 4.

On the other hand, as a result of fluid flow experiments or numerical analysis on the vertical pulverizing apparatus, it has been proved that the throat vanes 40 in the background-art vertical pulverizing apparatus are abraded severely for the following reason.

As shown in FIG. 8, the particles 68 falling down along the inner peripheral wall surface of the housing 32 slide down on the top surface of the slope part 43. The particles 68 which have reached the top end surface 40*a* of each throat vane 40 have a diagonally downward velocity component. Therefore, the particles 68 temporarily enter the annular flow channel between the throat inner peripheral wall 41 and the throat outer peripheral wall 42. When the particles 68 are blown upward by the primary air 61 flowing in the annular flow channel, a part of the particles 68 collide with the throat vanes 40, causing abrasion of the throat vanes 40, as shown in FIG. 9.

In addition, due to the downward velocity component of the particles 68 arriving at the top end surface 40*a* of each throat vane 40, lumps with a large particle size enter more deeply into the annular flow channel. Accordingly, there also arises another problem that the large coal lumps may fall down into a wind box 31 under the throat vanes 40 easily, in addition to the abrasion of the throat vanes 40. Further, incidental equipment for treating the falling lumps is required to increase the manufacturing cost of the vertical pulverizing apparatus.

The present invention has been developed in consideration of such actual circumferences inherent in the background art. An object of the invention, is to provide a vertical pulverizing apparatus capable of suppressing abrasion of throat vanes and elongating their abrasion resistant lives to thereby increase working efficiency.

Solution to Problem

In order to attain the foregoing object, the present invention is aimed at a vertical pulverizing apparatus including: a housing; a pulverizing table which is placed rotatably inside the housing; a pulverizer such as a pulverizing roller, which is disposed on the pulverizing table; a throat which is disposed between the housing and the pulverizing table; a wind box which is placed under the throat; and a conveying gas feeding unit such as a primary air duct, which feeds pulverized particle conveying gas such as primary air to the wind box, the throat having an annular flow channel which is surrounded by a throat inner peripheral wall and a throat outer peripheral wall and which is configured to be partitioned by a large number of throat vanes circumferentially at predetermined intervals so that a solid raw material such as coal can be pulverized to produce pulverized particles by meshing of the pulverizing table with the pulverizer, and the conveying gas fed from the conveying gas feeding unit to the wind box can be jetted to an outer peripheral part of the pulverizing table through the throat so as to convey the pulverized particles to above the pulverizing table.

Provided is a first means of the invention, wherein: a slope part extending diagonally downward from an inner peripheral wall surface of the housing toward a top end of the throat outer peripheral wall and a horizontal part extending from a bottom end of the slope part continuously to the top end of the throat outer peripheral wall are provided all over the circumference between the housing and the throat; and top end surfaces of the throat vanes and a top surface of the horizontal part are set at the same height.

According to a second means of the invention, there is provided the first means, wherein:

the top end surface of each of the throat vanes is formed into a horizontal surface.

According to a third means of the invention, there is provided the first or second means, wherein:

the slope part, the horizontal part and the throat are formed into an integral structure, and the integral structure is attached to the outer peripheral part of the pulverizing table so as to rotate together with the pulverizing table; and a gap is formed between the housing and the slope part so that a part of the conveying gas can be jetted to above the pulverizing table through the gap.

According to a fourth means of the invention, there is provided the first or second means, wherein:

the slope part is divided into an inside slope part and an outside slope part disposed on the radially outer side of the inside slope part, and the inside slope part, the horizontal part and the throat are attached to the outer peripheral part of the pulverizing table so as to rotate together with the pulverizing table while the outside slope part is attached to the inner peripheral wall surface of the housing; and a gap is formed between the inside slope part and the outside slope part so that a part of the conveying gas can be jetted to above the pulverizing table through the gap.

According to a fifth means of the invention, there is provided the fourth means, wherein:

a slope angle of the inside slope part is substantially equal to a slope angle of the outside slope part.

According to a sixth means of the invention, there is provided the first or second means, wherein:

the slope part, the horizontal part and the throat outer peripheral wall are formed into an integral structure, and the integral structure is attached to the inner peripheral wall surface of the housing;

the throat inner peripheral wall and the throat vanes are attached to the outer peripheral part of the pulverizing table so as to rotate together with the pulverizing table; and a gap between the throat outer peripheral wall and each of the throat vanes is formed inside the annular flow channel between the throat inner peripheral wall and the throat outer peripheral wall.

According to a seventh means of the invention, there is provided the first or second means, wherein:

the slope part, the horizontal part and the throat are formed into an integral structure, and the integral structure is attached to the inner peripheral surface of the housing; and a gap is formed between the throat and the pulverizing table.

Advantageous Effects of Invention

According to the present invention configured as described above, it is possible to provide a vertical pulverizing apparatus capable of suppressing abrasion of throat vanes and elongating their abrasion resistant lives to thereby increase working efficiency.

DESCRIPTION OF EMBODIMENTS

Embodiments of the invention will be described below with reference to the drawings.

First Embodiment

Figure 1:
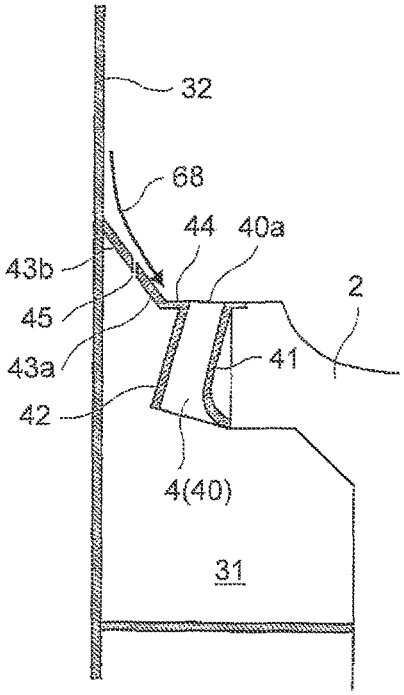
FIG. 1 A sectional view of the vicinities of a throat portion of a vertical pulverizing apparatus according to a first embodiment of the invention.
Figure 7:
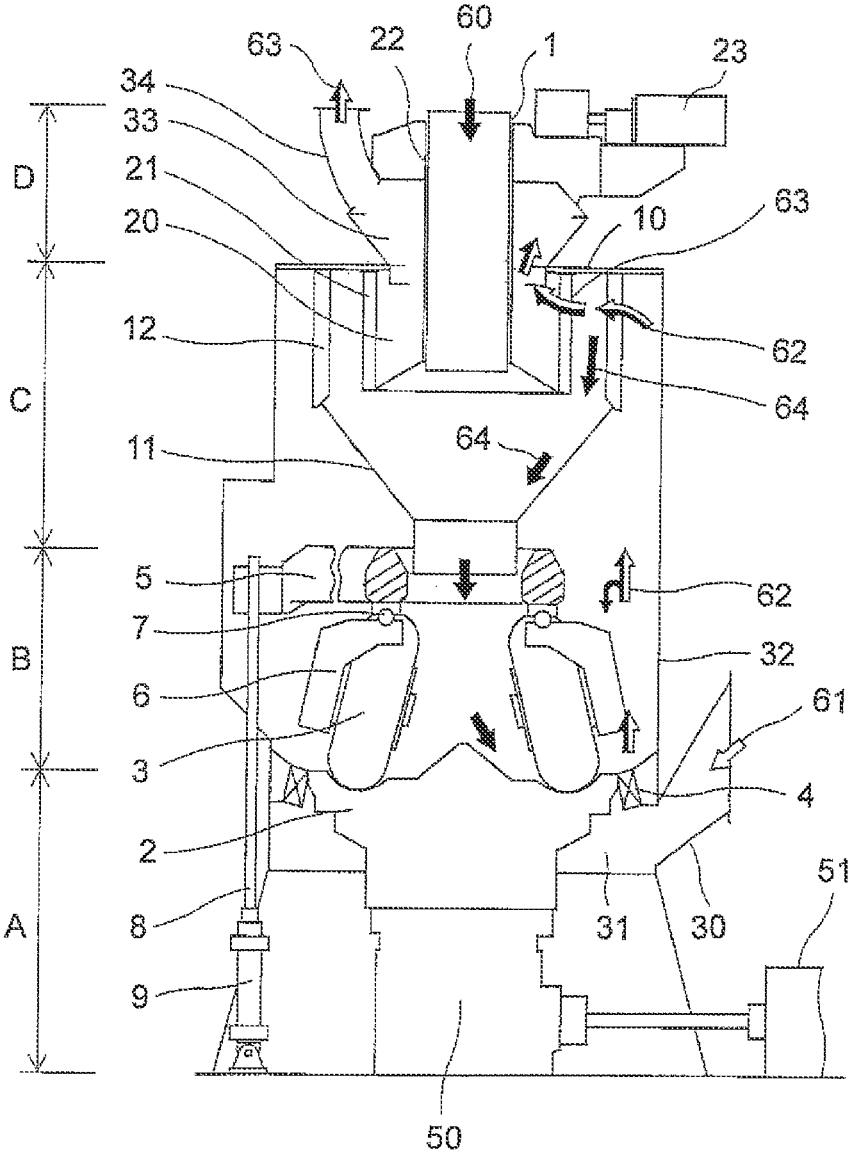
FIG. 7 A schematic configuration view of a background-art vertical pulverizing apparatus.

FIG. 1 is a sectional view of the vicinities of a throat portion of a vertical pulverizing apparatus according to a first embodiment of the invention. The overall configuration, functions, etc. of the vertical pulverizing apparatus are similar to those in the vertical pulverizing apparatus shown in FIG. 7, and their description will be omitted.

As shown in FIG. 1, a throat 4 is an annular flow channel surrounded by a throat inner peripheral wall 41 and a throat outer peripheral wall 42. In addition, a large number of throat vanes 40 each inclined at a desired angle $\alpha$ with respect to a rotation direction X of a pulverizing table 2 are placed at intervals in the circumferential direction of the throat 4 so that a turning force can be given to primary air 61 jetted from the throat 4.

In the embodiment, as shown in FIG. 1, the throat 4 is a rotary type throat which is attached to the pulverizing table 2 so as to rotate together with the pulverizing table 2.

An inside slope part 43*a* which is fixed to the throat 4 so as to rotate together with the throat 4 and an outside slope part 43*b* which is fixed to a housing 32 so as not to rotate are placed between the top end of the throat outer peripheral wall 42 (that is, the outer peripheral edge of a top end surface 40*a* of each throat vane 40) and the housing 32. The slope surface of the inside slope part 43*a* and the slope surface of the outside slope part 43*b* are substantially on the same plane, and a slope part 43 is constituted by the inside slope part 43*a* and the outside slope part 43*b*.

A gap 45 is formed between the inside slope part 43*a* and the outside slope part 43*b*. This gap 45 will be described later.

In addition, a horizontal part 44 whose planar shape is annular is provided between the outer peripheral edge of the top end surface 40*a* of each throat vane 40 and the inner peripheral edge of the inside slope part 43*a*.

Particles 68 falling down along the inner peripheral wall of the housing 32 slide down on the slope surface extending from the outside slope part 43*b* to the inside slope part 43*a*. On arriving at the horizontal part 44, the particles 68 change their moving direction from a diagonally downward direction to a lateral direction. That is, when the particles 68 arrive at the top end surface 40*a* of each throat vane 40, a downward velocity component disappears.

Therefore, there is no fear that the particles 68 may enter into the annular flow channel between the throat inner peripheral wall 41 and the throat outer peripheral wall 42, but the particles 68 are blown upward by the primary air 61 jetted from the annular flow channel. As a result, the particles 68 hardly collide with the throat vanes 40 so that abrasion of the throat vanes 40 can be suppressed. In addition, lumps with a large particle size hardly enter into the annular flow channel. Accordingly, the problem that the large lumps may flow down into a window box 31 located under the throat vanes 40 can be also solved.

In the embodiment, the slope part 43 is divided into the inside slope part 43*a* and the outside slope part 43*b*. This configuration has two advantages as follows.

(1) It is easy to adjust the gap 45 between the inside slope part 43*a* and the outside slope part 43*b*. When the gap 45 is too wide, the amount of the primary air 61 leaking out through the gap 45 increases to cause reduction of the flow rate of the primary air 61 flowing in the annular flow channel between the throat inner peripheral wall 41 and the throat outer peripheral wall 42. Thus, the velocity of the air flow is lowered. As a result, the particles 68 fall down into the annular flow channel easily. To suppress this, the gap 45 is adjusted to be several mm.

The outer diameter of the inside slope part 43*a* which can rotate has very high roundness due to machining or the like. However, in a vertical pulverizing apparatus for use in a coal fired boiler plant, the housing 32 is a huge cylinder whose diameter is 4 to 5 meters, and the inner diameter of the housing 32 has a circumferential distortion (deviation from a true circle) of about ten-odd mm.

Then, high roundness can be set in the inner diameter of the outside slope part 43*b*, for example, by adjustment of the attachment position of the outside slope part 43*b* or machining of the outside slope part 43*b*. Thus, the gap 45 between the inside slope part 43*a* and the outside slope part 43*b* can be adjusted to be about several mm easily.

(2) A part of the particles 63 which are falling down can be blown to above the pulverizing table 2 by the primary air 61 jetted upward from the gap 45. It has been confirmed by flow analysis or the like that, in spite of the gap 45 about several mm wide, the flow velocity of the primary air 61 jetted therefrom becomes substantially equal to the flow velocity of the primary air 61 flowing in the annular flow channel, and the flow velocity reaches several tens m/s.

In this manner, a part of the particles 68 sliding down on the slope part 43*b* are blown away so that the amount of the particles 68 arriving at the top end surface 40*a* of each throat vane 40 can be reduced.

It is desirable that the slope angle of the inside slope part 43*a* is substantially equal to the slope angle of the outside slope part 43*b*. However, a difference in slope angle between the both can be allowed if the slope angles are not smaller than the repose angle of the particles 68 sliding down. For example, a difference in slope angle may be provided between the outside slope part 43*b* whose slope angle is increased and the inside slope part 43*a* whose slope angle is decreased.

Figure 5:
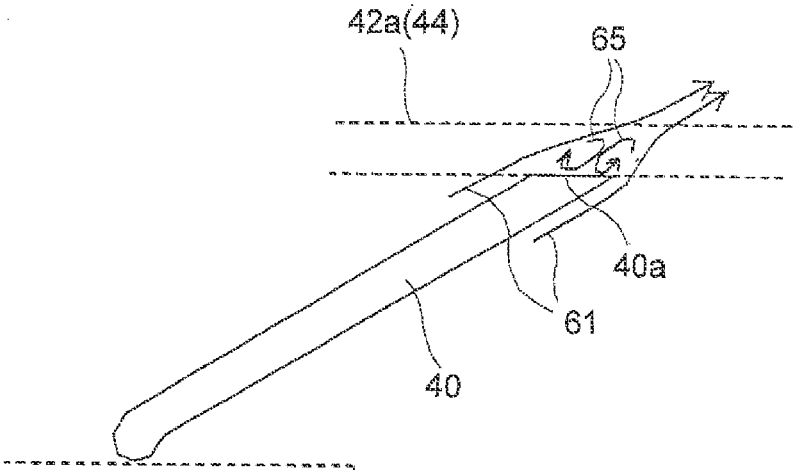
FIG. 5 An enlarged development view of a throat vane according to a comparative example.

FIG. 5 is an enlarged development view of a throat vane according to a comparative example. A stagnant part 65 where a flow velocity is locally slow is formed near the top end surface 40*a* of each throat vane 40. As shown in FIG. 5, when the top end surface 40*a* of the throat vane 40 is lower than a top end 42*a* of the throat outer peripheral wall 42 and the horizontal part 44, a part of the particles 68 supplied from the horizontal part 44 fall down to the top end surface 40*a* of the throat vane 40 and enter into the annular flow channel. The part of the particles 68 supplied from the horizontal part 44 fall down in the stagnant part 65. That is, when the particles 68 arrive at the top end surface 40*a* of the throat vane 40, the particles 68 have a downward velocity component again. Thus, the particles 68 enter into the annular flow channel easily.

When the particles 6 are blown by the primary air 61 flowing in the annular flow channel, the particles 68 collide with the throat inner peripheral wall 41 or the throat outer peripheral wall 42, causing abrasion in that part.

Figure 6:
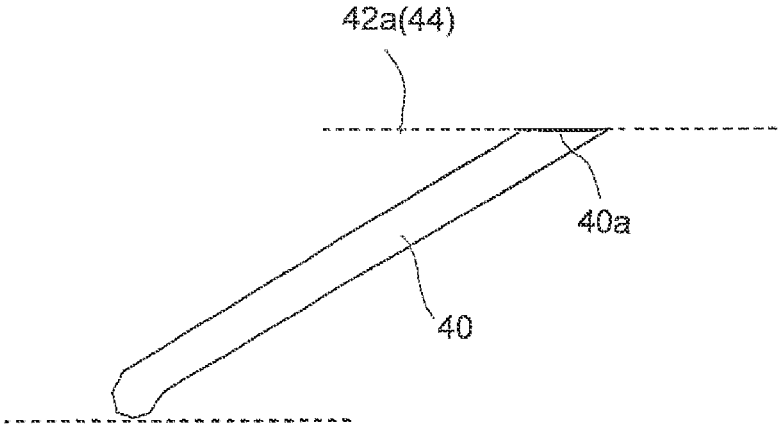
FIG. 6 An enlarged development view of a throat vane according to an embodiment of the invention.

FIG. 6 is an enlarged development view of a throat vane according to an embodiment of the invention. In the embodiment, as shown in FIG. 6, the top end surface 40*a* of each throat vane 40, the top end 42*a* of the throat outer peripheral wall 42 and the top surface of the horizontal part 44 are set at the same height in order to prevent abrasion in the throat inner peripheral wall 41 or the throat outer peripheral wall 4.

Figure 8:
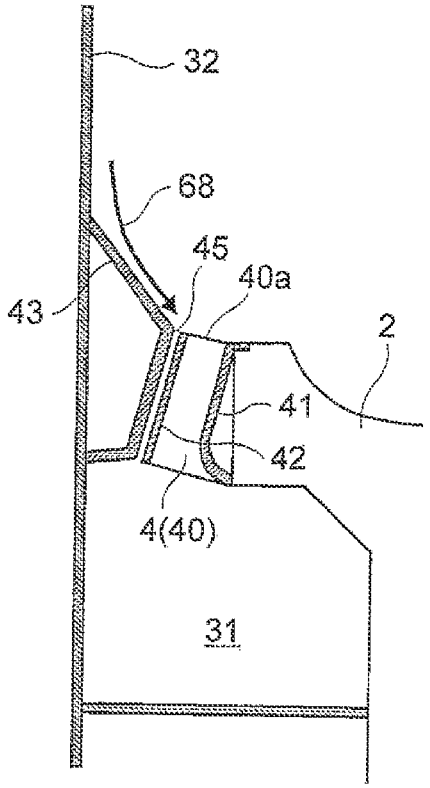
FIG. 8 A sectional view of the vicinities of a throat portion of the background-art vertical pulverizing apparatus.
Figure 9:
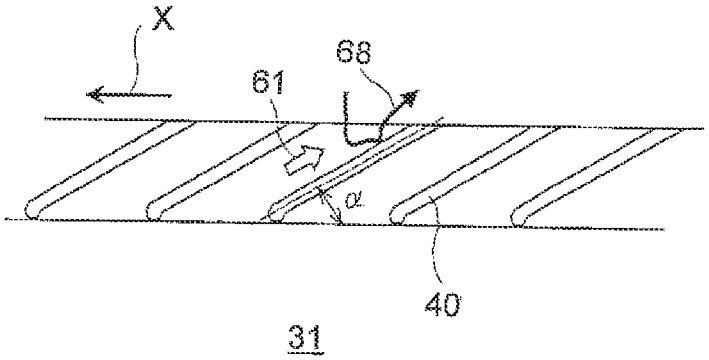
FIG. 9 A development view of a throat of the background-art vertical pulverizing apparatus.

In addition, in the embodiment, as shown in FIG. 6, the top end surface 40*a* of the throat vane 40 is formed into a horizontal surface. In the background-art vertical pulverizing apparatus, as shown in FIG. 8, the top end surface 40*a* of the throat vane 40 is inclined to be higher on the outer side, and the throat vane 40 has a shape in which the throat vane 40 protrudes more upward on the outer side than on the inner side. Thus, the throat vane 40 is abraded easily on the outer side to thereby shorten the useful life of the throat vane 40. To solve this problem, the top end surface 40*a* of the throat vane 40 is formed into a horizontal surface in the embodiment.

It is desirable that the radial width (length) of the horizontal part 44 is at least 10 mm in consideration of the size of particles (coal particles in the embodiment) circulating inside the vertical pulverizing apparatus and the necessity to change the moving direction of the particles 68 falling down along the slope part 43 to a lateral direction.

Second Embodiment

Figure 2:
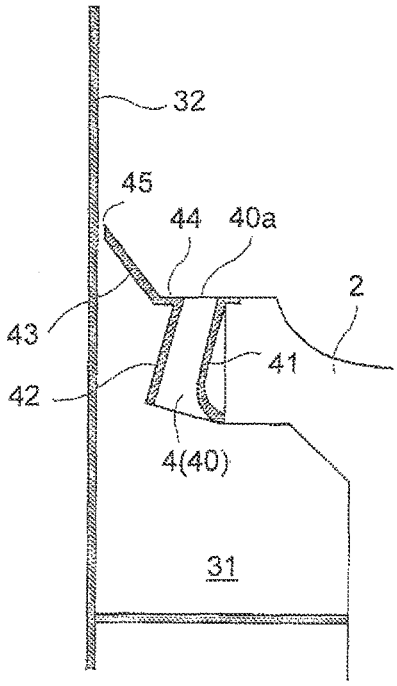
FIG. 2 A sectional view of the vicinities of a throat portion of a vertical pulverizing apparatus according to a second embodiment of the invention.

FIG. 2 is a sectional view of the vicinities of a throat portion of a vertical pulverizing apparatus according to a second embodiment of the invention.

This embodiment is different from the first embodiment shown in FIG. 1 at the point that the slope part 43 is not divided into two, but the slope part 43 consisting of one member is attached to the pulverizing table 2, and the gap 45 is formed between the slope part 43 and the housing 32. A part of particles 68 falling down can be blown upward by the primary air 61 jetted upward from the gap 45. Thus, the amount of particles 68 arriving at the too end surface 40*a* of each throat vane 40 can be reduced.

This embodiment has such an advantage that the slope part 43*b* fixed to the housing 32 can be eliminated so that the number of parts can be reduced and assembling can be made easy, as compared with the first embodiment.

Third Embodiment

Figure 3:
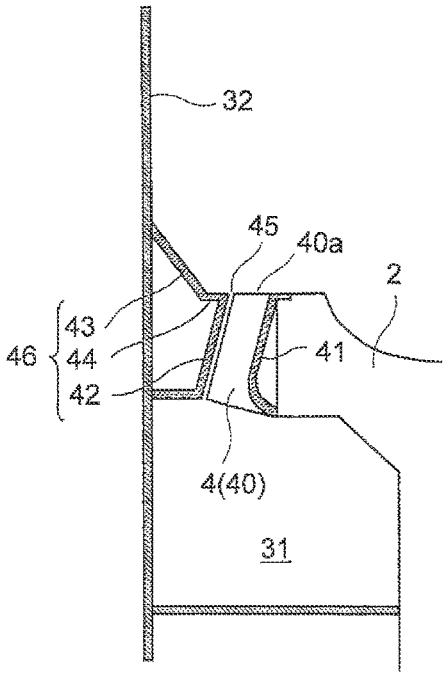
FIG. 3 A sectional view of the vicinities of a throat portion of a vertical pulverizing apparatus according to a third embodiment of the invention.

FIG. 3 is a sectional view of the vicinities of a throat portion of a vertical pulverizing apparatus according to a third embodiment of the invention.

In this embodiment, an integral structure 46 in which the slope part 43, the horizontal part 44 and the throat outer peripheral wall 42 are formed integrally is fixed to the housing 32. On the other hand, the throat inner peripheral wall 41 and the throat vanes 40 are fixed to the pulverizing table 2. Accordingly, as shown in FIG. 3, the gap 45 is formed in the annular flow channel between the throat inner peripheral wall 41 which is rotating and the throat outer peripheral wall 42 which is fixed. The gap 45 becomes a part of the annular flow channel.

According to this configuration, the flow rate of the primary air 61 flowing in the annular flow channel remains the same even when the gap 45 is widened. There fore, there is an advantage that the size of the gap 45 can be increased.

Fourth Embodiment

Figure 4:
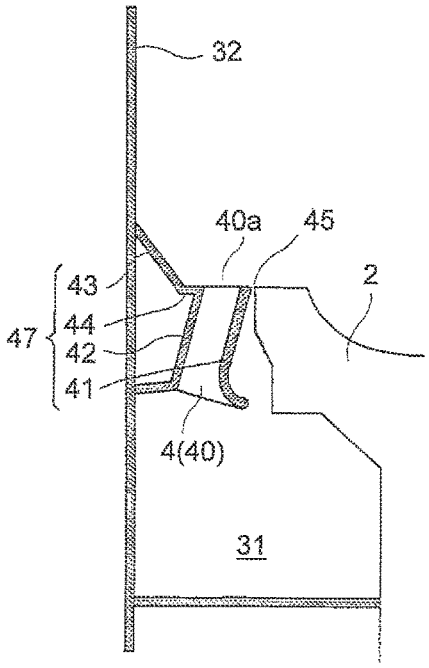
FIG. 4 A sectional view of the vicinities of a throat portion of a vertical pulverizing apparatus according to a fourth embodiment of the invention.

FIG. 4 is a sectional view of the vicinities of a throat portion of a vertical pulverizing apparatus according to a fourth embodiment of the invention.

An integral structure 47 in which the slope part 43, the horizontal part 44, the throat outer peripheral wall 42, the throat inner peripheral wall 41 and the throat vanes 40 are formed integrally serves as a fixed type throat which is fixed to the housing 32. Accordingly, the gap 45 is formed between the pulverizing table 2 and the throat inner peripheral wall 41.

In spite of such a fixed type throat, the horizontal part 44 can be provided between the top end of the throat outer peripheral wall 42 (that is, the outer edge of the top end surface 40*a* of each throat vane 40) and the slope part 43 as shown in FIG. 4.

According to each of the embodiments of the invention, abrasion of the throat can be suppressed so that the abrasion resistant life of the throat can be elongated. As a result, the replacement frequency of the throat can be reduced so that a vertical pulverizing apparatus with high working efficiency can be provided. In addition, when the abrasion resistant life is elongated, the maintenance cost of the vertical pulverizing apparatus can be reduced.

Further, according to the invention, the problem that large lumps may fall down into the primary air wind box under the throat can be also solved. Therefore, incidental equipment for treating the falling lumps can be dispensed with. Thus, the manufacturing cost of the vertical pulverizing apparatus can be reduced.

Although a vertical pulverizing apparatus for pulverizing coal has been described in each of the embodiments the invention is not limited thereto. For example, the invention is also applicable to a vertical pulverizing apparatus for pulverizing another kind of solid matter such as biosolid including woody chips or the like, cement, etc.

Although pulverizing rollers are used for pulverizing solid matter in the embodiments, the invention is not limited thereto. For example, the invention is also applicable to a vertical pulverizing apparatus using another pulverizer such as a pulverizing ball.

REFERENCE SIGNS LIST

2: pulverizing table
3: pulverizing roller
4: throat
30: primary air duct
31: primary air wind box
32: housing
40: throat vane
40*a*: top end surface of throat vane
41: throat inner peripheral wall
42: throat outer peripheral wall
43: slope part
43*a*: inside slope part
43*b*: outside slope part
44 horizontal part
45: gap
46, 47: integral structure
61: primary air
62: group of particles
65: stagnant part
B: pulverization portion
C: classification portion

The invention claimed is:

1. A vertical pulverizing apparatus comprising: a housing; a pulverizing table which is placed rotatably inside the housing; a pulverizer which is disposed on the pulverizing table; a throat which is disposed between the housing and the pulverizing table; a wind box which is placed under the throat; and a conveying gas feeding unit which feeds pulverized particle conveying gas to the wind box, the throat having an annular flow channel which is surrounded by a throat inner peripheral wall and a throat outer peripheral wall and which is configured to be partitioned by a large number of throat vanes circumferentially at predetermined intervals so that a solid raw material can be pulverized to produce pulverized particles by meshing of the pulverizing table with the pulverizer, and the conveying gas fed from the conveying gas feeding unit to the wind box can be jetted to an outer peripheral part of the pulverizing table through the throat so as to convey the pulverized particles to above the pulverizing table; wherein:

a slope part extending diagonally downward from an inner peripheral wall surface of the housing toward a top end of the throat outer peripheral wall and a horizontal part extending from a bottom end of the slope part continuously to the top end of the throat outer peripheral wall are provided all over the circumference between the housing and the throat; and top end surfaces of the throat vanes and a top surface of the horizontal part are set at the same height.

2. A vertical pulverizing apparatus according to claim 1, wherein:

the top end surface of each of the throat vanes is formed into a horizontal surface.

3. A vertical pulverizing apparatus according to claim 1 or 2, wherein:

the slope part, the horizontal part and the throat are formed into an integral structure, and the integral structure is attached to the outer peripheral part of the pulverizing table so as to rotate together with the pulverizing table; and a gap is formed between the housing and the slope part so that a part of the conveying gas can be jetted to above the pulverizing table through the gap.

4. A vertical pulverizing apparatus according to claim 1, wherein:

the slope part is divided into an inside slope part and an outside slope part disposed on the radially outer side of the inside slope part, and the inside slope part, the horizontal part and the throat are attached to the outer peripheral part of the pulverizing table so as to rotate together with the pulverizing table while the outside slope part is attached to the inner peripheral wall surface of the housing; and a gap is formed between the inside slope part and the outside slope part so that a part of the conveying gas can be jetted to above the pulverizing table through the gap.

5. A vertical pulverizing apparatus according to claim 4, wherein:

a slope angle of the inside slope part is substantially equal to a slope angle of the outside slope part.

6. A vertical pulverizing apparatus according to claim 1 or 2, wherein:

the slope part, the horizontal part and the throat outer peripheral wall are formed into an integral structure, and the integral structure is attached to the inner peripheral wall surface of the housing;

the throat inner peripheral wall and the throat vanes are attached to the outer peripheral part of the pulverizing table so as to rotate together with the pulverizing table; and a gap between the throat outer peripheral wall and each of the throat vanes is formed inside the annular flow channel between the throat inner peripheral wall and the throat outer peripheral wall.

7. A vertical pulverizing apparatus according to claim 1, wherein:

the slope part, the horizontal part and the throat are formed into an integral structure, and the integral structure is attached to the inner peripheral surface of the housing; and a gap is formed between the throat and the pulverizing table.

* * * * *